US009393468B2

(12) United States Patent
Sukman

(10) Patent No.: US 9,393,468 B2
(45) **Date of Patent: *Jul. 19, 2016**

(54) GOLF CLUB HEAD WITH IMPROVED MASS DISTRIBUTION

(71) Applicant: Dunlop Sports Co. Ltd., Kobe-shi (JP)

(72) Inventor: Jesse D. Sukman, Arlington, VA (US)

(73) Assignee: Dunlop Sports Co. Ltd., Kobe-shi (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/518,492

(22) Filed: Oct. 20, 2014

(65) Prior Publication Data

US 2015/0038257 A1 Feb. 5, 2015

Related U.S. Application Data

(63) Continuation of application No. 13/896,951, filed on May 17, 2013, now Pat. No. 8,882,608, which is a continuation of application No. 13/548,744, filed on Jul. 13, 2012, now Pat. No. 8,460,122, which is a (Continued)

(51) Int. Cl.
*A63B 53/04* (2015.01)
*A63B 59/00* (2015.01)

(52) U.S. Cl.
CPC ..... *A63B 53/047* (2013.01); *A63B 53/04* (2013.01); *A63B 53/0487* (2013.01); *A63B 59/0092* (2013.01); *A63B 60/52* (2015.10);

(Continued)

(58) Field of Classification Search
CPC .. A63B 53/047; A63B 53/0487; A63B 53/04; A63B 59/0092; A63B 49/06; A63B 2053/0433; A63B 2053/0437; A63B 2053/0491; A63B 2053/045; A63B 60/52; A63B 60/54
USPC ..... 473/324–350, 287–292
See application file for complete search history.

(56) References Cited

U.S. PATENT DOCUMENTS 1,854,548 A 4/1932 Hunt
2,460,435 A 2/1949 Schaffer (Continued)

FOREIGN PATENT DOCUMENTS

JP 08-010359 1/1996

OTHER PUBLICATIONS

MX-15 and MX-23 Irons, Golf Equipment Universal Catalogue, 2004, p. 245.

(Continued)

*Primary Examiner* — Sebastiano Passaniti
(74) *Attorney, Agent, or Firm* — Steptoe & Johnson LLP

(57) ABSTRACT

An iron type golf club head including a striking wall having front and rear surfaces, a rearwardly extending perimeter-weighted element which includes heel, toe, top, and sole portions, the sole portion including a forward end, rearward end, and an upper surface, the intersection of the upper surface of the sole portion and the rear surface of the striking wall defining an interior sole line, the intersection of the upper surface of the sole portion and the rearward end of the sole portion defining a trailing-edge sole line, the perimeter-weighted element having one or more rearwardly-opening recesses therein; and a polymeric element affixed to the sole portion, wherein, in a imaginary vertical plane substantially perpendicular to the striking wall, when the golf club head is in an address position, the interior sole line is below the trailing-edge sole line.

21 Claims, 23 Drawing Sheets

Related U.S. Application Data continuation of application No. 13/200,758, filed on Sep. 30, 2011, now Pat. No. 8,246,486, which is a continuation of application No. 12/929,559, filed on Feb. 1, 2011, now Pat. No. 8,075,419, which is a continuation of application No. 12/801,477, filed on Jun. 10, 2010, now Pat. No. 7,901,298, which is a continuation of application No. 12/461,614, filed on Aug. 18, 2009, now Pat. No. 7,789,772, which is a continuation of application No. 11/196,413, filed on Aug. 4, 2005, now Pat. No. 7,594,864.

(60) Provisional application No. 60/598,897, filed on Aug. 5, 2004.

(52) U.S. Cl.
CPC ..... *A63B 60/54* (2015.10); *A63B 2053/045* (2013.01); *A63B 2053/0433* (2013.01); *A63B 2053/0437* (2013.01); *A63B 2053/0491* (2013.01)

(56) References Cited

U.S. PATENT DOCUMENTS

| | | | | | |
|---|---|---|---|---|---|
| 2,846,228 | A | * | 8/1958 | Reach | A63B 53/04 473/332 |
| 3,079,157 | A | | 2/1963 | Turner | |
| 3,220,733 | A | | 11/1965 | Saleeby | |
| D256,264 | S | | 8/1980 | Solheim | |
| 4,252,262 | A | | 2/1981 | Igarashi | |
| 4,630,825 | A | | 12/1986 | Schmidt et al. | |
| 4,667,963 | A | | 5/1987 | Yoneyama | |
| 4,740,345 | A | | 4/1988 | Nagasaki et al. | |
| 4,928,972 | A | | 5/1990 | Nakanishi et al. | |
| 5,176,384 | A | | 1/1993 | Sata et al. | |
| 5,184,823 | A | | 2/1993 | Desboilles et al. | |
| 5,193,805 | A | | 3/1993 | Solheim | |
| 5,209,473 | A | | 5/1993 | Fisher | |
| 5,290,036 | A | * | 3/1994 | Fenton | A63B 53/04 273/DIG. 8 |
| 5,316,298 | A | * | 5/1994 | Hutin | A63B 53/04 273/DIG. 23 |
| 5,330,187 | A | | 7/1994 | Schmidt et al. | |
| 5,409,229 | A | | 4/1995 | Schmidt et al. | |
| 5,437,456 | A | | 8/1995 | Schmidt et al. | |
| 5,464,218 | A | | 11/1995 | Schmidt et al. | |
| 5,486,000 | A | | 1/1996 | Chorne | |
| 5,544,885 | A | | 8/1996 | Besnard et al. | |
| 5,586,947 | A | * | 12/1996 | Hutin | A63B 53/04 473/324 |
| 5,595,548 | A | | 1/1997 | Beck | |
| 5,683,310 | A | | 11/1997 | Chen | |
| 5,695,412 | A | | 12/1997 | Cook | |
| 5,722,900 | A | | 3/1998 | Sung | |
| 5,776,010 | A | | 7/1998 | Helmstetter et al. | |
| 5,807,191 | A | | 9/1998 | Nakahara | |
| 6,015,354 | A | | 1/2000 | Ahn et al. | |
| 6,030,295 | A | | 2/2000 | Takeda | |
| 6,102,812 | A | * | 8/2000 | Takeda | A63B 3/04 473/291 |
| 6,440,010 | B1 | | 8/2002 | Deshmukh | |
| D469,833 | S | | 2/2003 | Roberts et al. | |
| 6,921,344 | B2 | | 7/2005 | Gilbert et al. | |
| 7,025,695 | B2 | | 4/2006 | Mitsuba | |
| 7,083,531 | B2 | | 8/2006 | Aguinaldo et al. | |
| 7,131,913 | B2 | | 11/2006 | Iwata et al. | |
| 7,238,119 | B2 | * | 7/2007 | Roach | A63B 53/047 473/332 |
| 7,481,718 | B2 | | 1/2009 | Soracco | |
| 7,594,864 | B2 | | 9/2009 | Sukman | |
| 7,789,772 | B2 | | 9/2010 | Sukman | |
| 7,901,298 | B2 | | 3/2011 | Sukman | |
| 8,075,419 | B2 | | 12/2011 | Sukman | |
| 8,246,486 | B2 | | 8/2012 | Sukman | |
| 8,460,122 | B2 | | 6/2013 | Sukman | |
| 2002/0065140 | A1 | | 5/2002 | Iwata et al. | |
| 2003/0092502 | A1 | | 5/2003 | Pergande et al. | |
| 2003/0139227 | A1 | | 7/2003 | Sugimoto | |
| 2003/0181259 | A1 | | 9/2003 | Shimazaki | |
| 2003/0203764 | A1 | | 10/2003 | Dabbs et al. | |
| 2003/0228928 | A1 | | 12/2003 | Yabu | |
| 2005/0037864 | A1 | | 2/2005 | Gilbert et al. | |
| 2005/0239572 | A1 | | 10/2005 | Roach et al. | |
| 2008/0051220 | A1 | | 2/2008 | Soracco et al. | |

OTHER PUBLICATIONS

Ping G2, Golf Equipment Universal Catalogue, 2004, p. 138.

PGA.com Value Guide, the National Standard for Golf Club Values—Callaway Golf Steelhead X16 Iron Set golf club, info and specs found at: http://valueguide.pga.com/detail-exec/brand/2675/product_type/205/mode1/44582/b/ Callaway/p/Iron%20set/m/Steelhead%20X-16, retrieved Mar. 12, 2012.

PGA.com Value Guide, the National Standard for Golf Club Values—Callaway Golf Steelhead X16 Pro Series Iron set Graphite Shaft, info and specs found at: http://valueguide.pga.com/detail-exec/brand/2675/product_type/205/model/44583/b/Callaway/p/Iron%20set/m/Steelhead%20X-16%20Pro%20Series , retrieved Mar. 12, 2012.

PGA.com Value Guide, the National Standard for Golf Club Values—Callaway Golf Hawk Eye Iron set Graphite Shaft, info and specs found at: http://valueguide.pga.com/detailexec/brand/2675/product_type/205/mode1/44077/b/Callaway/p/Iron%20set/m/Hawk%20Eye , retrieved Mar. 12, 2012.

PGA.com Value Guide, the National Standard for Golf Club Values—Callaway Golf Hawk Eye VFT Iron set gold club, info and specs found at: http://valueguide.pga.com/detailexec/brand/2675/product_type/205/mode1/44079/b/Callaway/p/Iron%20set/m/Hawk%20Eye%20VFT, retrieved Mar. 12, 2012.

PGA.com Value Guide, the National Standard for Golf Club Values — Cobra Gravity Back Iron set, info and specs found at: http://valueguide.pga.com/detail- exec/brand/2678/product_type/205/model/44030/b/Cobra/p/Iron%20set/ m/Gravity%20Back , retrieved Jul. 12, 2012.

* cited by examiner

GOLF CLUB HEAD WITH IMPROVED MASS DISTRIBUTION

CROSS-REFERENCE TO RELATED APPLICATION

The present application is a continuation of application Ser. No. 13/896,951, filed May 17, 2013, which is a continuation of application Ser. No. 13/548,744, filed Jul. 13, 2012, now U.S. Pat. No. 8,460,122 which is a continuation of application Ser. No. 13/200,758, filed Sep. 30, 2011, now U.S. Pat. No. 8,246,486, which is a continuation of application Ser. No. 12/929,559, filed Feb. 1, 2011, now U.S. Pat. No. 8,075,419, which is a continuation of application Ser. No. 12/801,477, filed Jun. 10, 2010, now U.S. Pat. No. 7,901,298, which is a continuation of application Ser. No. 12/461,614, filed Aug. 18, 2009, now U.S. Pat. No. 7,789,772, which is a continuation of application Ser. No. 11/196,413, filed Aug. 4, 2005, now U.S. Pat. No. 7,594,864, and claims priority of U.S. Provisional Patent Application Ser. No. 60/598,897, filed Aug. 5, 2004, the entirety of the disclosure of which is hereby incorporated by reference into the present application.

BACKGROUND

The present invention relates to the design of golf clubs, and more particularly to the design of iron-type golf club heads and putters.

The significance of improving the mass distribution of golf club heads is well-recognized in the art. For example, perimeter weighting elements in golf club heads are commonly used to increase moment of inertia and thereby provide enhanced resistance to twist, resulting in a more forgiving golf club head in the case of an off-center golf ball impact.

Those skilled in the art have long recognized that a low and rearward center of gravity may provide performance benefits such as a higher launch angle for higher handicapped golfers, as well as improved feel. Some of these benefits have been realized via "undercut" iron-type club heads, i.e. golf club heads with perimeter weighting elements having sole portions with mass concentrated towards the rear thereof, as illustrated in FIG. 1. The FIG. 1 cross-sectional view depicts a golf club head 110 in an orientation wherein it would be addressing a golf ball to be struck, i.e., a so-called "address position." The club head comprises a striking wall 112, a top portion 114 and a sole portion 116 extending rearwardly from the striking wall 112. The interior cavity surface of sole portion 116 comprises surface portions 115, which intersect at corners 113, forming an undercut 117. Undercut 117 may be considered to be a corner-type undercut. Despite performance benefits such as increased moment of inertia about the center of gravity and improved feel, golf club head designs having undercut configurations of the corner-type may present problems in casting and manufacturing, thereby increasing overall production cost.

Furthermore, Golf club heads enhance the golfer's performance most successfully where the golf club head has solid, uninterrupted surfaces, thereby instilling confidence in the player, a key element of golf club performance. Undercut configurations of existing golf club heads do not provide optimal mass distribution with respect to heel-side and toe-side weighting. The existing undercut configurations may interfere with the solid and continuous appearance of the golf club head, resulting in perceived instability and corresponding poor performance.

Undercut configurations of existing perimeter-weighted club heads do not provide adequate mass distribution relative to the heel and toe portions.

Therefore, a need exists for a golf club head which redistributes mass such that optimal performance characteristics are achieved while overcoming the problems previously mentioned herein.

BRIEF SUMMARY OF THE INVENTION

It is an object of the present invention to overcome the above-discussed shortcomings of the prior art.

Such objects and other advantages are achieved by the various embodiments of the present invention, e.g., a golf club head comprising a striking wall having a front surface and a rear surface, a sole portion extending rearwardly from said rear surface, the sole portion having a forward end, a rearward end, an upper surface and a lower surface, with the intersection of the upper surface of the sole portion and the rear surface of the striking wall defining an interior sole line, the intersection of the upper surface of the sole portion and the rearward end surface of the sole portion defining a trailing-edge or exterior sole line, and the upper surface of the sole portion comprising a sink portion having variation in heel-to-toe (HT) contour. The sink portion may comprise a low-order front-to-rear (FR) contour. The inventive golf club head may be an iron-type golf club head including a perimeter weighting element.

The variation in heel-to-toe (HT) contour may comprise variation of at least one of: (a) the vertical height of the trailing edge sole line relative to the vertical height of the interior sole line, measured in the same vertical plane perpendicular to the striking face; (b) the vertical height of the interior sole line relative to the vertical height of the general outer periphery of said golf club head, measured in the same vertical plane perpendicular to the striking face; (c) the vertical height of the trailing edge sole line relative to the vertical height of the general outer periphery of the club head, measured the same in vertical plane perpendicular to the striking face; and (d) concavity as defined by front-to-rear (FR) contour.

The inventive golf club head may further comprise a heel portion and a toe portion with the variation occurring in a variation portion of the upper surface, the variation portion having a heel-most end and a toe-most end, each end being at a HT distance R×D from the centerline of said golf club head, where D is the HT distance from the centerline to the toe-most edge of the club head; and R is a coefficient less than or equal to 0.54.

Additionally, the location of the maximum difference in vertical height between the trailing edge sole line and the interior sole line, measured in the same vertical plane perpendicular to the striking face, may be intermediate the heel-most end and the toe-most end of the upper surface, and the minimum height of the interior sole line relative to the ground plane, measured in the same vertical plane perpendicular to the striking face, may be intermediate the heel-most end and the toe-most end of the upper surface.

Further, the inventive golf club head having a striking wall with a front surface and a rear surface, and a perimeter-weighted portion defined by a rearward surface, an outer surface and an inner surface, where the perimeter-weighted portion comprises a top portion, a sole portion, a heel portion and a toe portion, may additionally comprise an interior perimeter line formed by the intersection of the rear surface and the inner surface, a trailing edge perimeter line formed by the intersection of the inner surface and the rearward surface, the inner surface of the sole portion comprising a sink portion having variation in HT contour; and the interior sole line extending outward of the exterior sole line in at least one of the heel portion, the toe portion, and the top portion.

In yet another embodiment, the inventive golf club head may comprise a heel portion, toe portion, top portion and sole portion, the sole portion having an upper surface, lower surface and rearward surface. The intersection of the upper surface and the rear surface of the striking face may define an interior sole line, the intersection of the upper surface and the rearward surface of the sole defining a trailing edge sole line, the upper surface comprising a sink portion having low-order FR contour and variation in concavity in the HT direction, the concavity defined by the FR contour of the upper surface.

Still other aspects of the present invention are explained below in this specification.

BRIEF DESCRIPTION OF THE DRAWINGS

Other objects and further aspects of the present invention will be understood from the following drawings, which include illustrations of preferred embodiments of the advantageous golf club heads of the present invention, wherein:

FIG. 3(*a*) is a cross-sectional view of the club head of FIG. 3.

FIG. 4(*a*) is a cross-sectional view of the golf club head of FIG. 4;

FIG. 4(*b*) is a rear view of a golf club head of FIG. 4 showing the location and shape of the interior sole line;

FIG. 5(*a*) is a cross-sectional view of the golf club head of FIG. 5;

FIG. 5(*b*) is a rear view of the golf club head of FIG. 5 showing the location and shape of the interior sole line;

FIG. 5(*c*) is a sectional cut away view of a portion of the sole portion of an embodiment of the invention such as that illustrated in FIG. 5(*b*);

FIG. 14(*a*) is a sectional cut away view of a portion of the sole portion of an embodiment of the invention such as that illustrated in FIG. 14;

FIGS. 24(*a*)-(*c*) show cross-sections including the FR contour at first, second and third imaginary vertical planes A, B, and C, respectively, of FIG. 24;

FIG. 25(*a*) is a cross-sectional view of the club head of FIG. 25;

FIG. 25(*b*) is a rear view of the club head of FIG. 25;

FIGS. 26(*b*)-(*d*) are rear views of a cut away portion of the sole of golf club heads of the present invention illustrating angles alpha and beta whose sum is not 180°;

FIGS. 29(*a*) and 29(*b*) schematically illustrate various HT contours of the sink portion of a club head like that illustrated in FIG. 29;

DETAILED DESCRIPTION

Figure 1:
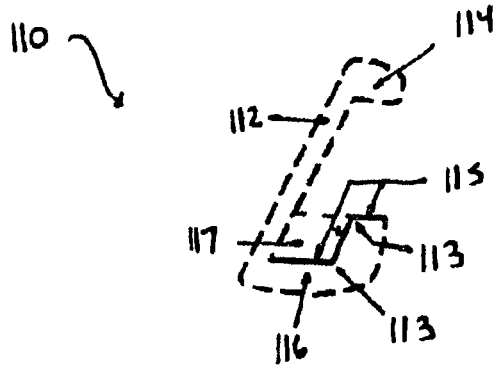
FIGS. 1 and 2 are cross-sectional views of golf club heads having an undercut configuration.
Figure 2:
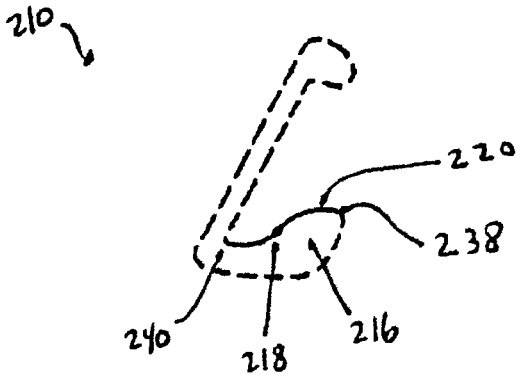

As shown in FIG. 2, a golf club head 210 is depicted in cross-section at address position. The golf club head 210 comprises a sole portion 216 with an upper surface 220. The cavity surface 220 on the upper and interior surface of sole portion 116 comprises curvilinear front-to-rear (FR) cross-sectional contour such that an apogee 238 of surface 220 lies rearward of a perigee 240 forming a sink or depression. Herein, a sink refers to a portion of the upper or cavity surface of the sole portion of a golf club head, having curvilinear or linear FR contour extending substantially from the forward-most end to the rearward-most end of the upper surface, in which the apogee of the upper surface lies rearward of the perigee in the address position for any FR cross-section within the sole portion.

A point of inflection may be present in that upper surface intermediate its forward-most and rearward-most ends. An inflection point 218 may be considered mathematically to represent a point on a curve which separates concavity and convexity. An inflection point, as considered herein, may also be expanded to include "kinks," i.e. points of generally abrupt changes in curvature along the FR contour of the upper surface. The golf club head 210 may be considered to have an inflection-type undercut.

Figure 3:
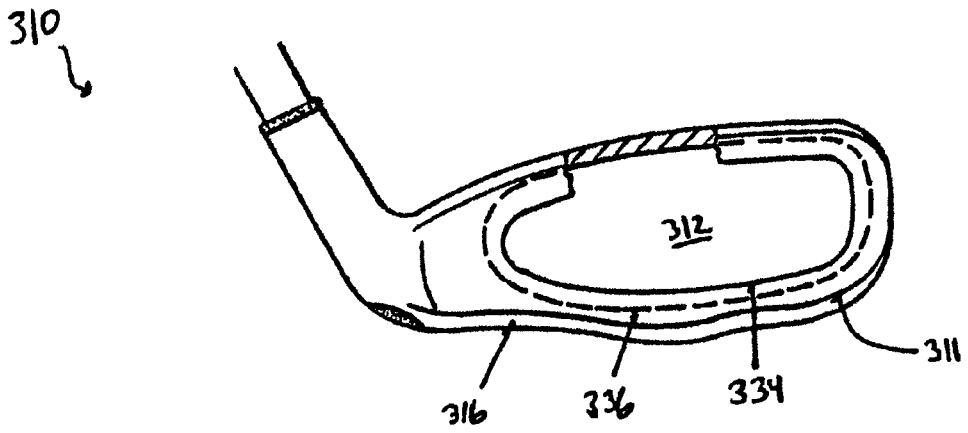
FIG. 3 is a rear, partially cut away view of a golf club head having a sole portion with a tapered upper surface.
Figure 3A:
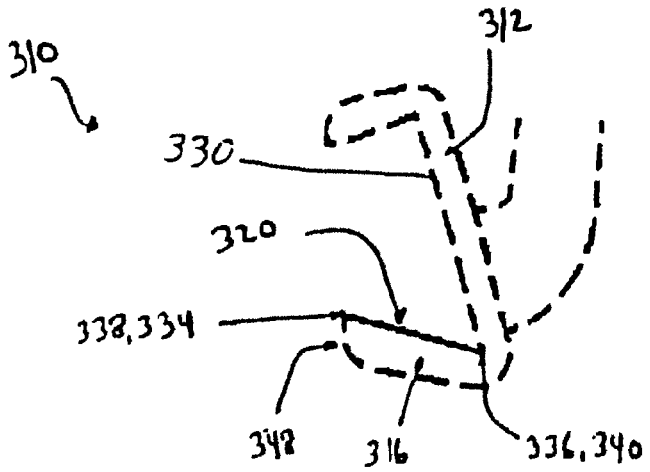

In FIGS. 3 and 3(*a*), another golf club head 310 is illustrated which moves the center of gravity rearward by having a sole portion 316 with an upper surface 320 gradually tapering downward in the forward direction, the golf club head 310 being in address position. In this case, no inflection point is discernible within the FR contour, yet an apogee 338 is rearward of a perigee 340. Thus, a sink is present. An FR contour wherein there is no discernible inflection point may be referred to herein as low order contour. Low order contour may include, but not be limited to, linear contour, concave curvature, or convex curvature. Concave or convex curvature may each include parabolic curvature, logarithmic curvature, exponential curvature, or the like. As shown in FIG. 3(*a*), apogee 338 of the FR contour coincides with the trailing-edge or exterior sole line 334 and perigee 340 coincides with interior sole line 336. Interior sole line 336 is formed at the intersection of the upper surface 320 and the rear surface 330 of the striking wall 312. Trailing edge sole line 334 is formed at the intersection between the upper surface 320 and the rearward end 348 of the sole portion 316.

The terms trailing edge or exterior sole line used herein refer to a line defined by a set of points lying on the rearward edge of the upper cavity surface of the sole. Such a trailing edge or exterior sole line may not necessarily be a sharp edge or junction of two surfaces.

As shown in FIG. 3, the interior sole line 336 and the exterior sole line 334 both generally follow the heel-to-toe (HT) contour of the lower outer periphery 311 of the club head 310

Figure 4:
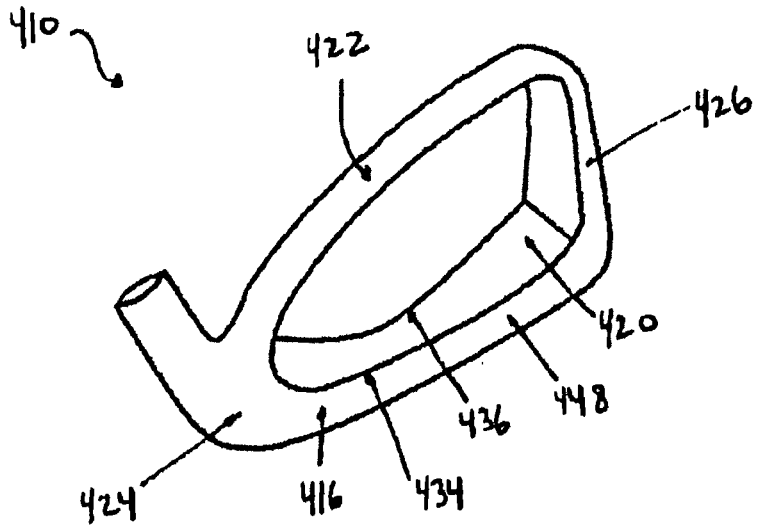
FIG. 4 is a rear, heel perspective view of a golf club head of the present invention having an inflection-type undercut configuration.
Figure 4A:
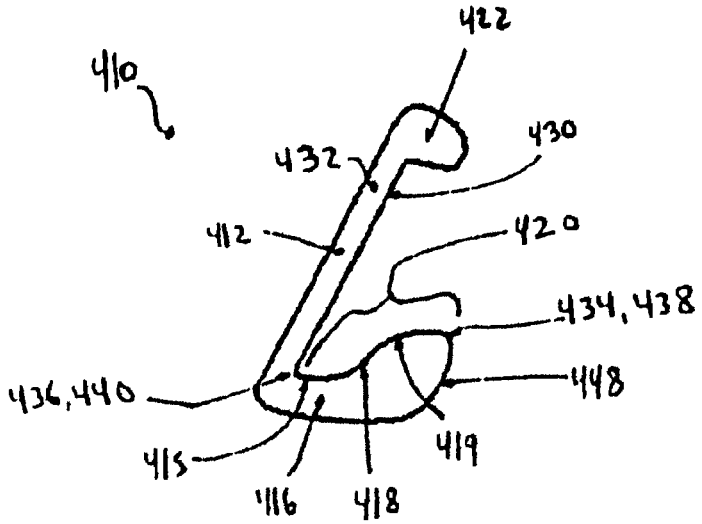
Figure 4B:
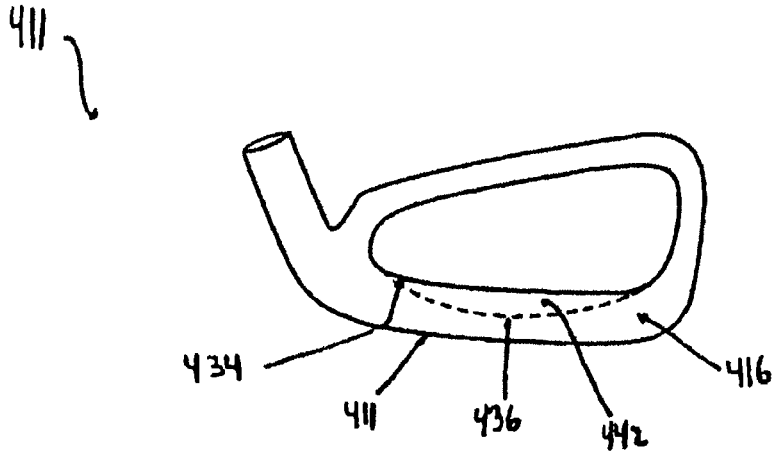

FIGS. 4, 4(*a*) and 4(*b*) illustrate a golf club head 410, in address position, having an inflection-type undercut configuration. Golf club head 410 comprises a heel portion 424, toe portion 426, top portion 422, and a sole portion 416. A striking wall 412 extends between the top portion 422, sole portion 416, heel portion 424 and toe portion 426. The striking wall 412 has a front surface 432 for impacting a golf ball and an opposing rear surface 430. The sole portion 416 comprises an upper or cavity surface 420. The upper surface 420 comprises a FR contour having a concave portion 415 and a convex portion 419 defining an inflection point 418 separating portions 415 and 419. The apogee 438 is rearward of the perigee 440, forming a sink. The intersection of the upper surface 420 and the rear surface 430 forms an interior sole line 436. The intersection of the upper surface 420 and the rearward-most end 448 forms a trailing edge sole line 434.

FIG. 4(*b*) shows the trailing edge sole line 434 generally following the HT contour of the outer periphery 411 of the golf club head 410, while the interior sole line 436 varies substantially in HT contour relative to the outer periphery 411 of the golf club head 410. Sink 442 is formed within the sole portion 416.

Figure 5:
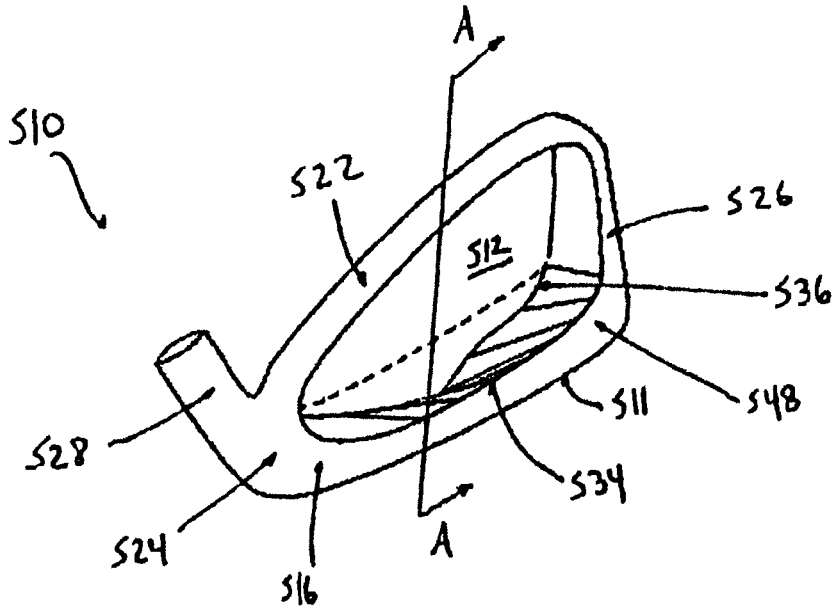
FIG. 5 is a rear, heel perspective view of a golf club head of the present invention having an inflection-type undercut configuration.
Figure 5A:
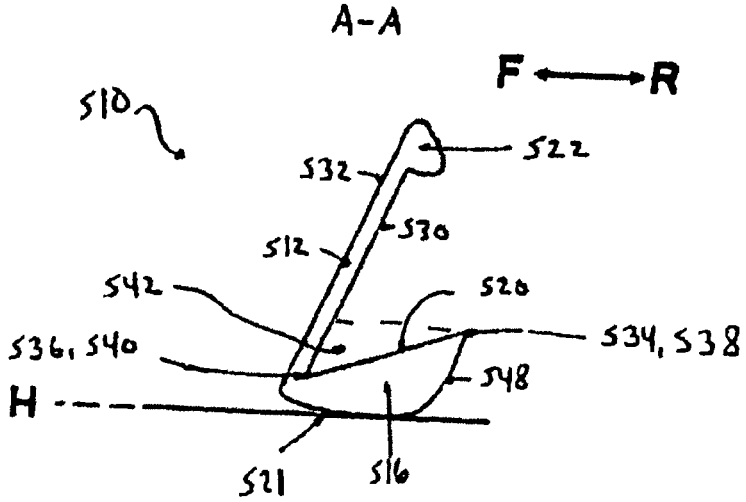
Figure 5B:
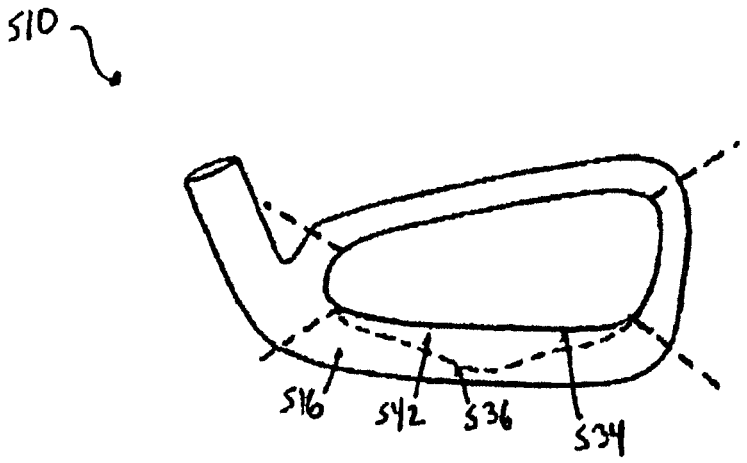
Figure 5C:
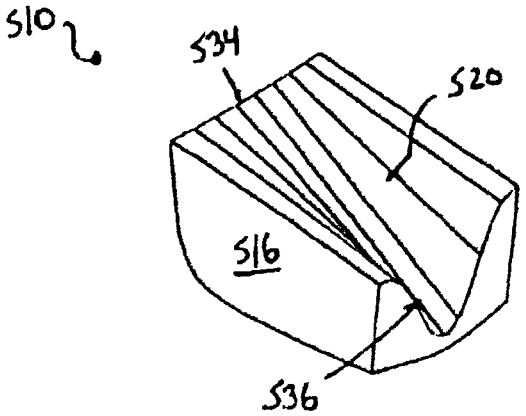

FIG. 5 illustrates another embodiment of the invention. A golf club head 510 is one of a set of perimeter weighted iron-type club heads. The golf club head 510 comprises a striking wall 512 having a front surface 532 (see FIG. 5(*a*)) for impacting a golf ball and an opposing rear surface 530. A top portion 522, a sole portion 516, a heel portion 524 and a toe portion 526 extend rearwardly from the rear surface 530 of the striking wall 512. A hosel 528 extends from the heel portion 524 for attachment to a shaft (not shown). The sole portion 516 comprises an upper or cavity surface 520, a rearward end 548 and a bottom surface 521. The upper surface 520 intersects the rear surface 530 forming an interior sole line 536, and the upper surface 520 intersects the rearward end 548 forming a trailing edge sole line 534. The HT contour of the trailing edge sole line 534 generally follows the outer periphery 511 of the golf club head 510. The HT contour of the interior sole line 536 varies relative to the outer periphery 511.

In FIG. 5(*a*), the club head 510 rests at address position. The FR contour of the upper surface 520 comprises a low order contour substantially from the interior sole line 536 to the trailing edge sole line 534. The FR contour of the upper surface 520 may be linear, concave, or convex. The apogee 538 coincides with the trailing edge sole line 534, and the perigee 540 coincides with the interior sole line 536. The apogee 538 is rearward of the perigee 540, forming a sink 542 (see FIG. 5(*b*)). It should be appreciated that for any FR cross-section of golf club head 510 within sink 542, the low order contour may be detected in the FR direction, substantially from the interior sole line 536 to the trailing edge sole line 534.

FIG. 5(*b*) is a rear elevation view of the embodiment of the invention shown in FIGS. 5-5(*a*) wherein golf club head 510 is shown in the address position. It should be appreciated that the sink 542 within the sole portion 516 may be depicted via the interior sole line 536 forming a path outward of the trailing edge sole line 534.

FIG. 5(*c*) shows a sectional cutaway view of a portion of the sole portion 516 of an embodiment of the invention. The upper surface 520 of the sole portion 516 bridges the profiles of the trailing edge sole line 534 and the interior sole line 536.

Figure 6:
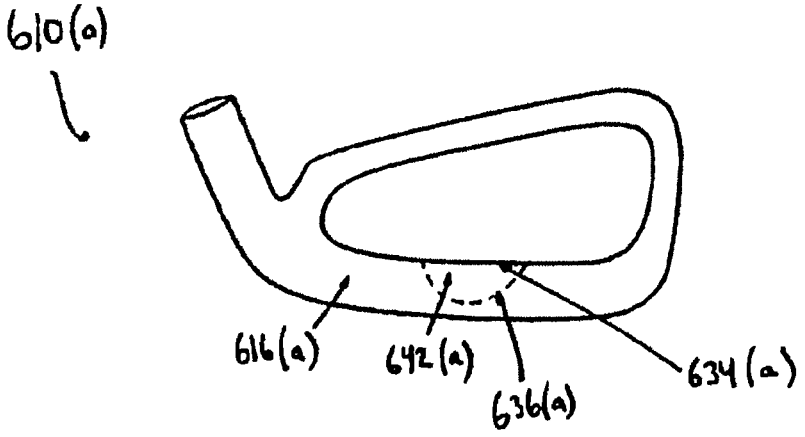
FIG. 6 is a rear view of another embodiment of a golf club head of the present invention showing a shape of the interior sole line.

FIG. 6 illustrates another embodiment of the invention comprising a golf club head 610(*a*) at address position, in rear elevation view, having a sole portion 616(*a*) with an upper surface (not shown). A sink 642 (*a*) extends for a portion of the HT length of the upper surface. Interior sole line 636(*a*) follows a generally arcuate path below the trailing edge sole line 634(*a*).

Figure 7:
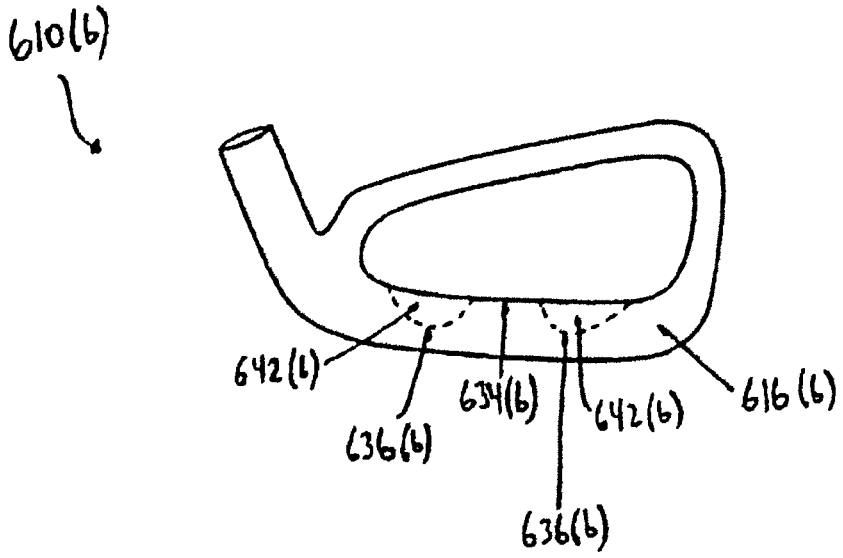
FIG. 7 is a rear view of another embodiment of a golf club head of the present invention showing a shape of the interior sole line.

FIG. 7 illustrates another embodiment of the invention comprising a golf club head 610(*b*) at address position, in rear elevation view, having two distinct sinks 642(*b*) within the upper surface (not shown) of the sole portion 616(*b*). Each sink 642(*b*) is indicated by the interior sole line 636(*b*) following a generally arcuate path outward of the trailing edge sole line 634(*b*).

Figure 8:
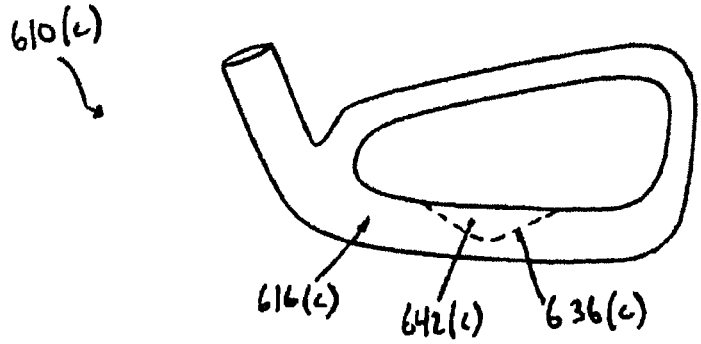
FIG. 8 is a rear view of another embodiment of a golf club head of the present invention showing a shape of the interior sole line.

FIG. 8 illustrates another embodiment of the invention comprising a golf club head 610(*c*) at address position, in rear elevation view, having a sink 642(*c*) within the upper surface of the sole portion 616(*c*). The sink 642(*c*) extends for a portion of the HT length of the upper portion. The interior sole line 636(*c*) forming the sink 642(*c*) follows a generally V-shaped path in the HT direction.

Figure 9:
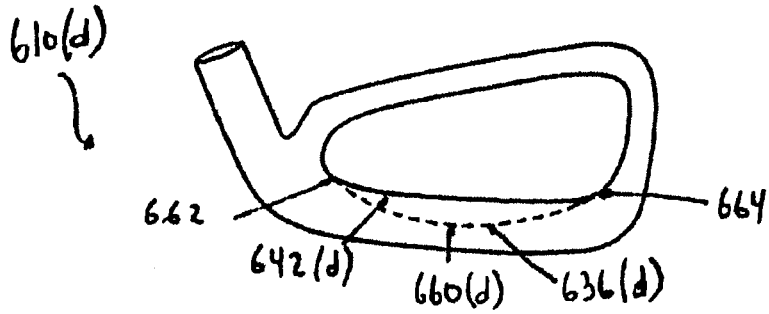
FIG. 9 is a rear view of another embodiment of a golf club head of the present invention showing a shape of the interior sole line.

FIGS. 9-14 each shows an additional embodiment of the invention, illustrating a golf club head at address position in rear elevation view. FIG. 9 illustrates an embodiment of the invention comprising a golf club head 610(*d*) with a sink 642(*d*) extending substantially the entire HT length of the upper portion (not shown). The interior sole line 636(*d*) follows a generally arcuate path and reaches a local minimum sole height 660(*d*) intermediate the heel-most end 662 and the toe-most end 664. In these additional embodiments a "local minimum sole height" refers to a physically defined depression formed in the interior sole line along the HT length of the upper surface. Such a local minimum sole height may be one minimum height among a plurality of such minima in a particular club head.

Figure 10:
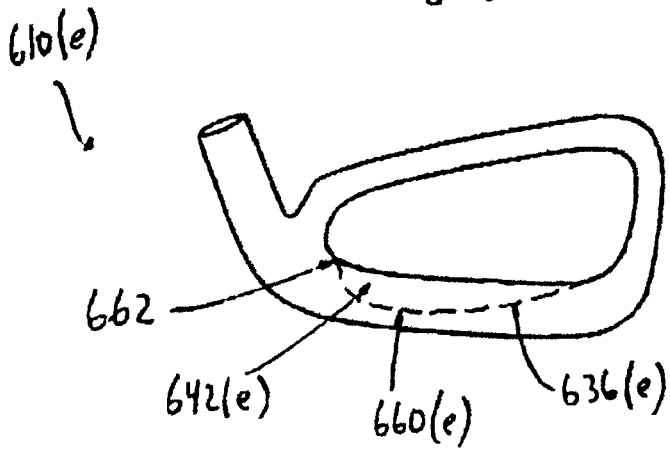
FIG. 10 is a rear view of another embodiment of a golf club head of the present invention showing a shape of the interior sole line.

FIG. 10 illustrates an embodiment of the invention comprising a golf club head 610(*e*) at address position with a sink 642(*e*) extending substantially throughout the entire HT length of the upper portion (not shown). The interior sole line 636(*e*) forming the sink 642(*e*) follows a generally arcuate path and reaches a local minimum sole height 660(*e*) toward the heel-most end 662.

Figure 11:
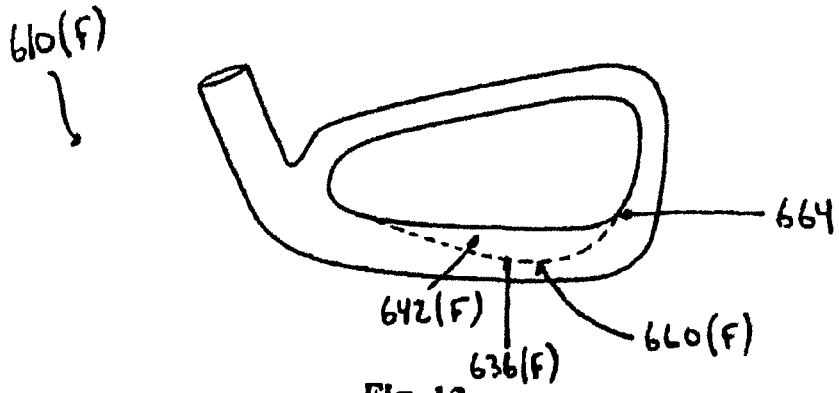
FIG. 11 is a rear view of another embodiment of a golf club head of the present invention showing a shape of the interior sole line.

FIG. 11 illustrates an embodiment of the invention comprising a golf club head 610(*f*) at address position with a sink 642(*f*) extending substantially throughout the entire HT length of the upper portion (not shown). The interior sole line 636(*f*) forming the sink 642(*f*) follows a generally arcuate path and reaches a local minimum sole height 660(*f*) toward the toe-most end 664.

Figure 12:
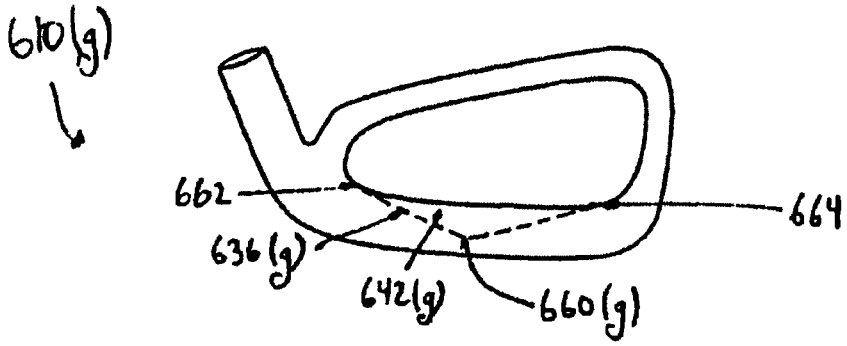
FIG. 12 is a rear view of another embodiment of a golf club head of the present invention showing a shape of the interior sole line.

FIG. 12 illustrates an embodiment of the invention comprising a golf club head 610(*g*) at address position having a sink 642(*g*). The interior sole line 636(*g*) within the sink 642(*g*) follows a generally V-shaped path reaching a local minimum sole height 660(*g*) intermediate the heel-most end 662 and the toe-most end 664 in the HT direction.

Figure 13:
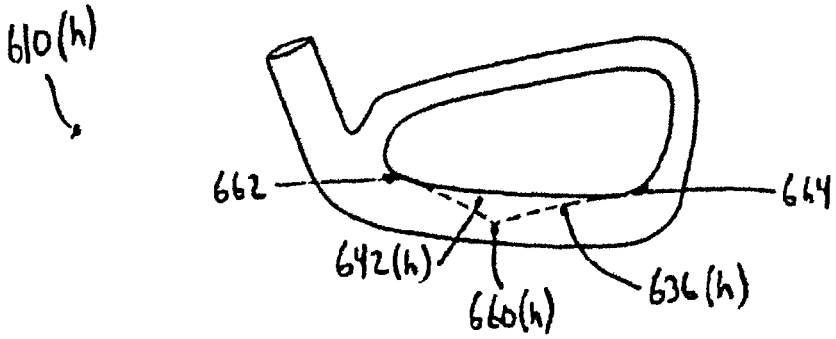
FIG. 13 is a rear view of another embodiment of a golf club head of the present invention showing a shape of the interior sole line.

FIG. 13 illustrates an embodiment of the invention comprising a golf club head 610(*h*) at address position having a sink 642(*h*). The interior sole line 636(*h*) forming the sink 642(*h*) follows a generally V-shaped path reaching a local minimum sole height 660(*h*) intermediate the heel-most end 662 and the toe-most end 664 in the HT direction. The HT contour of the interior sole line 636(*h*) comprises concave portions.

Figure 14:
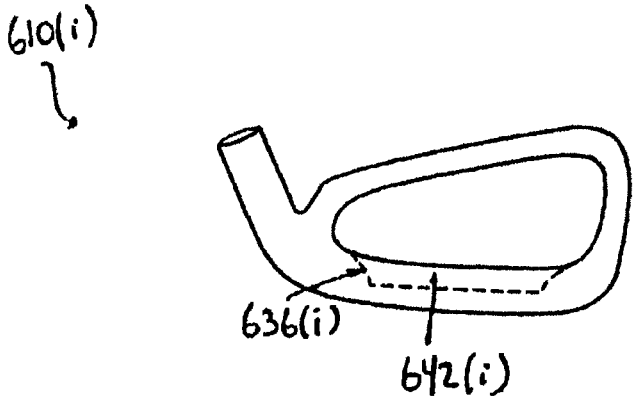
FIG. 14 is a rear view of another embodiment of a golf club head of the present invention showing a shape of the interior sole line.
Figure 14A:
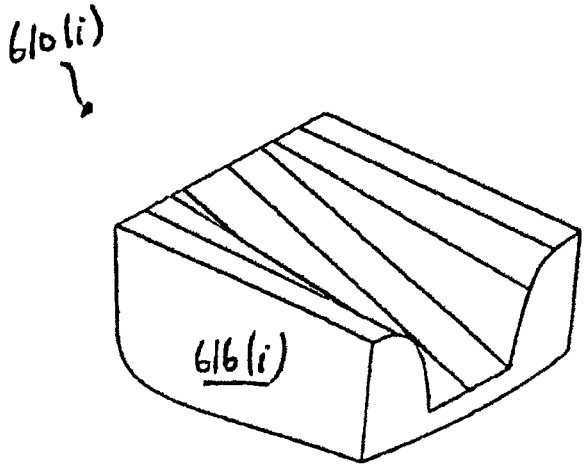

FIGS. 14 and 14(*a*) each illustrate an embodiment of the invention comprising a golf club head 610(*i*) at address position having a sink 642(*i*). The interior sole line 636(*i*) forming the sink 642(*i*) follows a flattened V-shaped path. The HT contour of the interior sole line 636(*i*) may comprise concave portions. FIG. 14(*a*) is a sectional cutaway view of a portion of the sole 616(*i*) as in FIG. 14.

Figure 15:
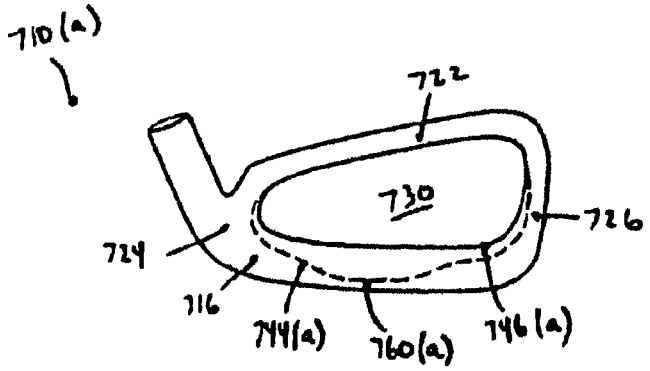
FIG. 15 is a rear view of another embodiment of a golf club head of the present invention showing a shape of the interior sole line.

FIG. 15 illustrates an embodiment of the invention comprising a golf club head 710(*a*) at address position in rear elevation view. The golf club head 710(*a*) comprises a top portion 722, heel portion 724, toe portion 726, and a sole portion 716 having an interior sole line 744(*a*), and an exterior sole line 746(*a*). The interior sole line 744(*a*) lies outward of the trailing edge sole line 746(*a*) within the sole portion 716, the heel portion 724 and the toe portion 726. Also, the interior sole line 744(*a*) forms a local minimum sole height 760(*a*) intermediate the heel-most end 762 and the toe-most end 764.

Figure 16:
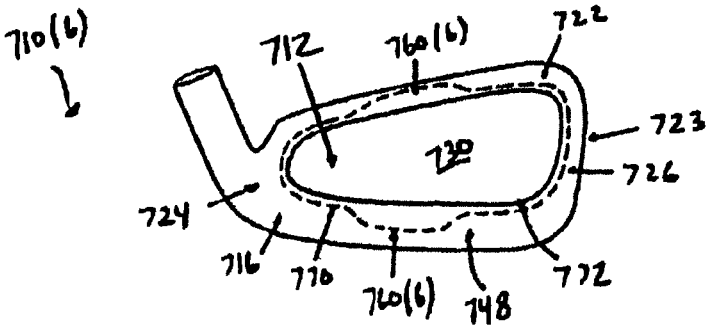
FIG. 16 is a rear view of another embodiment of a golf club head of the present invention showing a shape of the interior perimeter line.

FIG. 16 illustrates an embodiment of the invention comprising a golf club head 710(*b*) at address position in rear elevation view. Golf club head 710(*b*) comprises a top portion 722, heel portion 724, toe portion 726, and a sole portion 716 forming a perimeter weighting element 723. An interior perimeter line 770 is formed at the intersection between the inner surface of the perimeter weighting element 723 and the rear surface 730 of the striking wall 712. An exterior perimeter line 772 is formed at the intersection between the inner surface and the rearward surface 748 of the perimeter weighting element 723. The interior perimeter line 770 lies radially outward (from the center of the club head) of the exterior perimeter line 772 in the sole portion 716, heel portion 724, toe portion 726 and top portion 722. The perimeter thickness substantially varies within the top portion 722 and the within the sole portion 716. Local perimeter thickness minima 760(*b*) are formed intermediate the heel-most end 762 and the toe-most end 764 in the sole portion 716, and intermediate the heel-most end and the toe-most end in the top portion 722.

Figure 17:
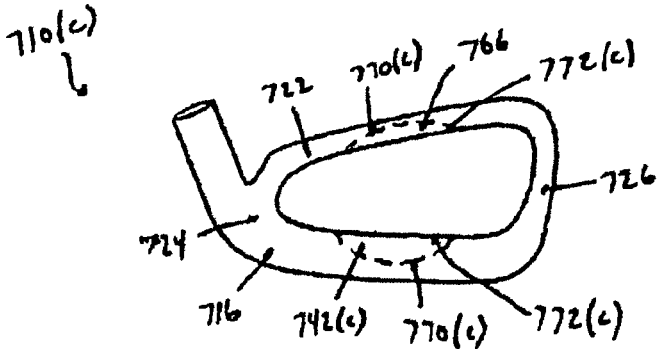
FIG. 17 is a rear view of another embodiment of a golf club head of the present invention showing a shape of the interior perimeter line.

FIG. 17 illustrates another embodiment of the invention comprising a golf club head 710(*c*) at address position in rear elevation view. A golf club head 710(*c*) comprises a top portion 722, sole portion 716, heel portion 724 and toe portion 726 forming a perimeter weighting element. A sink 742(*c*) is formed within the sole portion 716 as shown by interior perimeter line 770(*c*) lying outward of the exterior perimeter line 772(*c*). A second sink portion 766 exists within the top portion 722, in which the interior perimeter line 770(*c*) lies radially outside of the exterior perimeter line 772(*c*).

Figure 18:
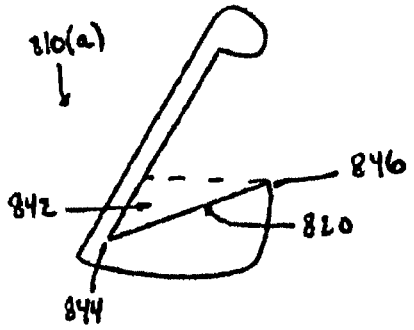
FIGS. 18-20 are each cross-sectional views of further embodiments of the golf club heads of the present invention wherein the sink comprises a low order FR contour.
Figure 19:
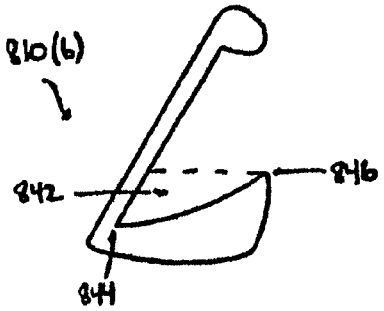
Figure 20:
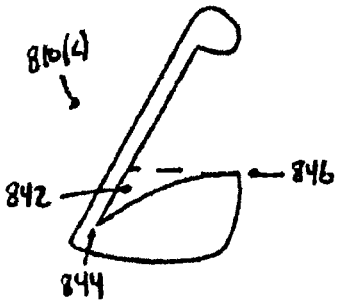

FIGS. 18-20 each shows another embodiment of the invention comprising a golf club head at address position in a FR cross-section, at an intermediate location of a sole portion. In FIG. 18, a golf club head 810(*a*) is shown wherein a sink 842 comprises a low order FR contour from substantially the forward-most point 844 to the rearward-most point 846 of the upper surface 820. In this case, the low order contour takes the form of a straight line.

In FIG. 19, a golf club head 810(*b*) is shown having a sink 842 and comprising a low order FR contour from substantially the forward-most point 844 to the rearward-most point 846 of the upper surface. In this case the low order contour takes the form of a concave curvature.

In FIG. 20, a golf club head 810(*c*) is shown having a sink 842 and comprising a low order FR contour from substantially the forward-most point 844 to the rearward-most point 846 of the upper surface. In this case the low order contour takes the form of a convex curvature.

Figure 21:
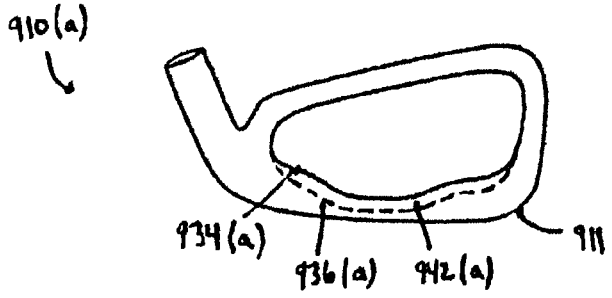
FIG. 21 is a rear view of another embodiment of a golf club head of the present invention showing a shape of the interior sole line.

FIG. 21 illustrates another embodiment of the invention. A golf club head 910(*a*) at address position is depicted in rear elevation view. A trailing edge sole line 934(*a*) and an interior sole line 936(*a*) are shown, the interior sole line lying radially outward of the trailing edge sole line 934(*a*), thus forming a sink 942(*a*). Both the interior sole line 936(*a*) and the trailing edge sole line 934(*a*) substantially vary in HT contour with respect to the outer periphery 911 of the golf club head 910(*a*). However, the HT contour of the trailing edge sole line 934(*a*) and the HT contour of the interior sole line 936(*a*) are substantially similar.

Figure 22:
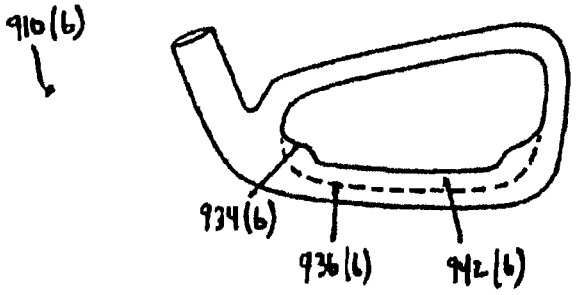
FIG. 22 is a rear view of another embodiment of a golf club head of the present invention showing a shape of the interior sole line.

FIG. 22 illustrates another embodiment of the invention. A golf club head 910(*b*) at address position is depicted in rear elevation view. Shown are trailing edge sole line 934(*b*) and an interior sole line 936(*b*) lying outward of the trailing edge sole line 934(*b*), thus forming a sink 942(*b*). The interior sole line 936(*b*) generally follows the contour of the outer periphery 911 of the golf club head 910(*b*) while the trailing edge sole line 934(*b*) substantially varies in HT contour with respect to the outer periphery 911 of the golf club head 910(*b*).

Figure 23:
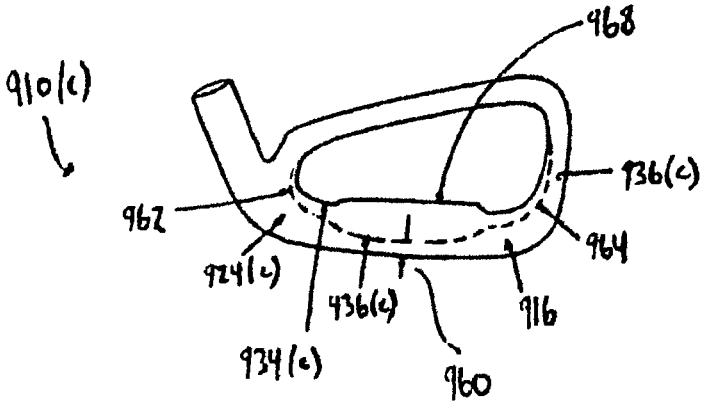
FIG. 23 is a rear view of another embodiment of a golf club head of the present invention showing a shape of the interior sole line.

FIG. 23 illustrates another embodiment of the invention. A golf club head 910(*c*) at address position is depicted in rear elevation view. Shown are trailing edge sole line 934(*c*) and an interior sole line 936(*c*) lying outward of the trailing edge sole line 934(*c*), thus forming a sink 942(*c*). The interior sole line 936(*c*) lies outward of the trailing edge sole line 934(*c*) in the sole portion 916, heel portion 924(*c*) and toe portion 926(*c*). The HT contour of the interior sole line 936(*c*) substantially varies, forming a local minimum sole height 960 intermediate the heel-most end 962 and the toe-most end 964 of the golf club head 910(*c*). The HT contour of the trailing edge sole line 934(*c*) varies forming a local maximum height 968 intermediate the heel-most end 962 and the toe-most end 964 of the golf club head 910(*c*).

Figure 24:
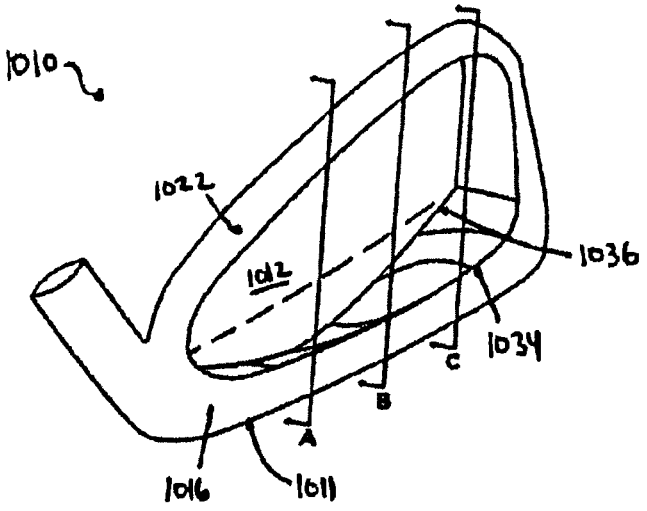
FIG. 24 is a rear, heel perspective view of a golf club head of the present invention showing variations in FR contour in the HT direction.
Figure 24A:
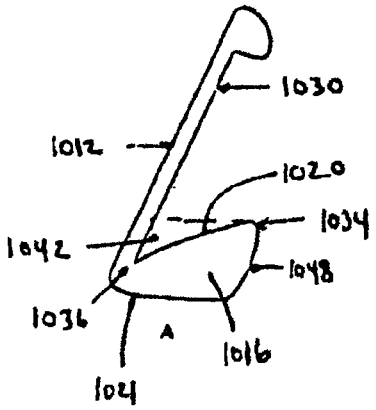
Figure 24B:
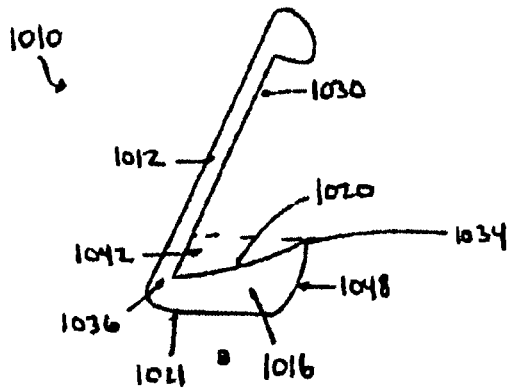
Figure 24C:
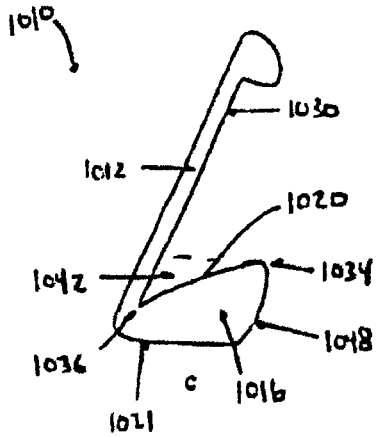

FIGS. 24 and 24(*a*)-(*c*) illustrate another embodiment of the invention. A golf club head 1010 is shown at address position having a top portion 1022, sole portion 1016, heel portion 1024 and a toe portion 1026. The sole portion 1016 extends rearwardly from a rear surface 1030 of a striking wall 1012. The sole portion 1016 comprises an upper surface 1020, bottom surface 1021 and a rearward end 1048. The intersection between the upper surface 1020 and the rear surface 1030 defines an interior sole line 1036. The intersection between the upper surface 1020 and the rearward end 1048 defines a trailing edge sole line 1034. The HT contour of the trailing edge sole line 1034 is generally parallel to the outer periphery 1011 of the golf club head 1010. The HT contour of the interior sole line 1036 substantially varies with respect to the outer periphery 1011 of the club head 1010 and forms a sink 1042 extending generally throughout the entire HT length of the upper surface 1020. The FR contour of the upper surface 1020 within the sink 1042 varies in the HT direction. At cross-sections A and C, the FR contour of the upper surface 1020 is convex, while at cross-section B, the FR contour of the upper surface 1020 is concave.

A golf club head in accordance with the invention described herein, may further incorporate a means for attenuating vibration associated with the impact of the golf club head with a golf ball. The means for attenuating vibration may take the form of a resilient insert coupled to the rear side of the golf club head. The insert may be coupled by means of an adhesive such as an epoxy, resin, or by mechanical means such as press-fit or mechanical fasteners.

In another embodiment the vibration attenuation means comprises a vibration absorption plaque coupled to the rear surface of the striking face. The plaque may be a constraining layer such as a rigid stress plate comprising a plastic or metallic material such as aluminum. Such vibration absorptive structures are described in Hutin et al. U.S. Pat. No. 5,316,298, the entire disclosure of which is hereby incorporated by reference in the present application.

The plaque may be coupled to the rear surface with a single joining layer such as an epoxy, resin, or a visco-elastic material. The plaque may alternatively be coupled to the rear surface by means of a visco-elastic material sandwiched by two layers of adhesive material such as a double-sided tape. Adhesive material may comprise an epoxy or resin. The exposed surface of the rigid plate may bear indicia such as trademarks.

It is also within the scope of the invention that a perimeter-weighted golf club head may comprise any of the embodiments mentioned herein in combination with at least one secondary recess, opening rearwardly through the rear surface of the top or top rail portion. A top rail having secondary recesses therein may still provide structural support for the top rail portion of a golf club head while permitting additional mass to be redistributed to other portions of the golf club head, particularly to the sole portion.

Figure 25:
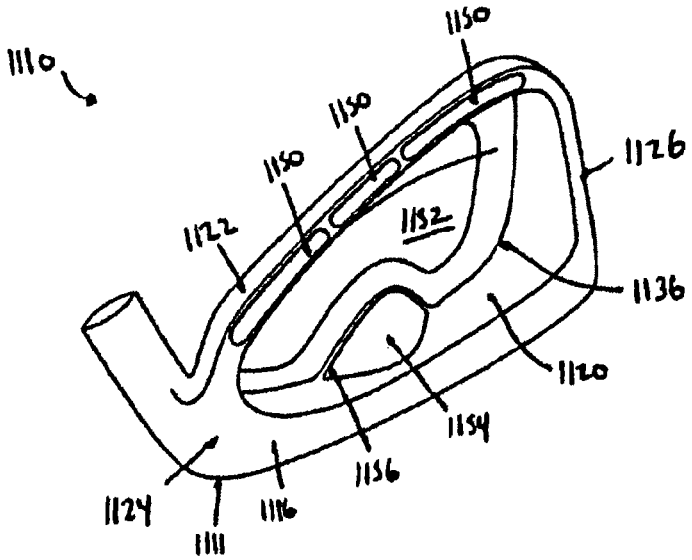
FIG. 25 is a rear, heel perspective view of another embodiment of the present invention additionally comprising an insert juxtaposed at the junction of the rear surface and the upper sole portion surface of a club head, with secondary recesses opening rearwardly through the rear surface of the top rail.
Figure 25A:
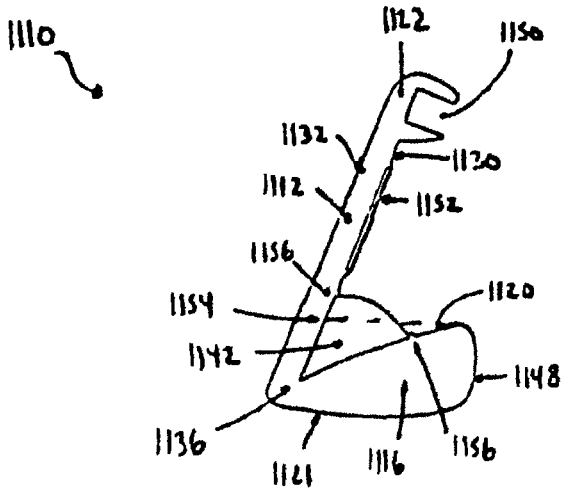
Figure 25B:
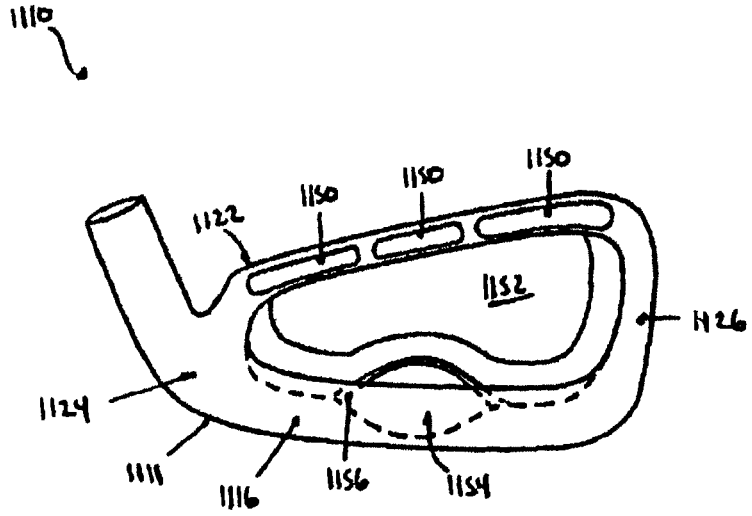
Figure 26A:
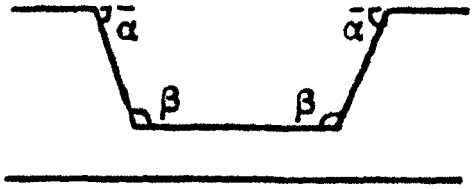
FIG. 26(*a*) is a rear view of a cut away portion of the sole of a golf club head illustrating complementary angles, alpha and beta.
Figure 26B:
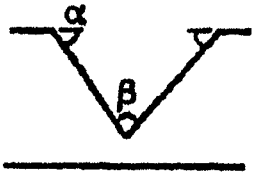
Figure 26C:
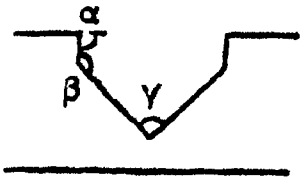
Figure 26D:
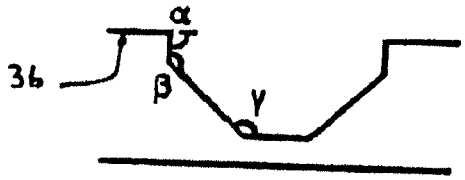

FIGS. 25, 25(*a*) and 25(*b*) illustrate another embodiment of the invention. A golf club head 1110 comprises a top portion 1122, a sole portion 1116, a heel portion 1124 and a toe portion 1126. A striking wall 1112 is formed having a front surface 1132 for impacting a golf ball and an opposing rear surface 1130. The sole portion 1116 comprises an upper surface 1120, sole rearward end 1148 and a bottom surface 1121. The upper surface 1120 is bounded in the FR direction by an interior sole line 1136 and a trailing edge sole line 1134. The interior sole line 1136 substantially varies in the HT direction with respect to the outer periphery 1111 of the golf club head 1110, forming a sink 1142.

An insert 1154 is juxtaposed with the upper surface 1120 and the rear surface 1130 of the striking wall 1112. A first peripheral rib 1156 encircles the insert 1154. The insert 1154 may be coupled to the sole portion 1116, the rear surface 1130 or both. The coupling means may be an adhesive such as epoxy, resin, tape, or visco-elastic material or mechanical means such as press-fit or fasteners. A visco-elastic plaque 1152 may be attached to the rear surface 1130 of the striking wall 1112 and may comprise a second peripheral rib 1158 encircling the visco-elastic plaque 1152. As an alternative, the plaque 1152 may be inserted into a re-entrant recess extending forwardly from the rear surface 1130 of the striking wall 1112. The top portion 1122 further comprises a plurality of secondary recesses 1150 opening rearwardly through the rear surface of the top rail portion. The secondary recesses 1150 permit redistribute of mass to a lower location.

The golf club head of the current invention may primarily be comprised of any material conventional to golf club head manufacture, such as steel, non-ferrous metallic alloys, titanium, aluminum, composites, plastics, rubbers, and the like. Preferably, the golf club head of the current invention comprises a relatively low density ferrous metal. More preferably, the ferrous metal comprises ductile iron and has a density within the range of about 5 to about 7.4 g/cm$^3$.

The embodiments discussed herein may be further combined with other known elements such as resilient inserts including polymers such as rubbers and polyurethane, silicone, metallic inserts including copper, tungsten, aluminum, titanium, steel, and bi-metallic combinations of the above and other metals. It is also intended that embodiments of the invention described herein may be combined with other structural elements known in the art, such as ribs, web portions, swing weights or plaques.

In all embodiments of the invention described herein, the HT contour of the interior sole line within each sink may be described as being continuously variant. Continuously variant includes curvilinear contours or contours comprising a set of corners having angles such that in the case of the interior sole line having less than five corners, no two adjacent corner angles may be supplementary, that is totaling up to 180 degrees.

FIG. 26(*a*) illustrates a cutaway rear view of a sole portion of a golf club head in which angle $\alpha$ and angle $\beta$ are adjacent and add up to 180 degrees by virtue of angles $\alpha$ and $\beta$ being alternate interior angles. FIG. 26(*b*) is a cutaway rear view illustrating an example of a continuously variant interior sole line 36. Angles $\alpha$ and $\beta$ are adjacent; however, angles $\alpha$ and $\beta$ do not add up to 180 degrees. FIG. 26(*c*) is a cutaway rear view illustrating another example of a continuously variant interior sole line 36. In this case, the interior sole line 36 forms a set of five corners. FIG. 26(*d*) is a cutaway rear view illustrating another example of a continuously variant interior sole line 36. The interior sole line 36 comprises 6 corners.

Figure 27:
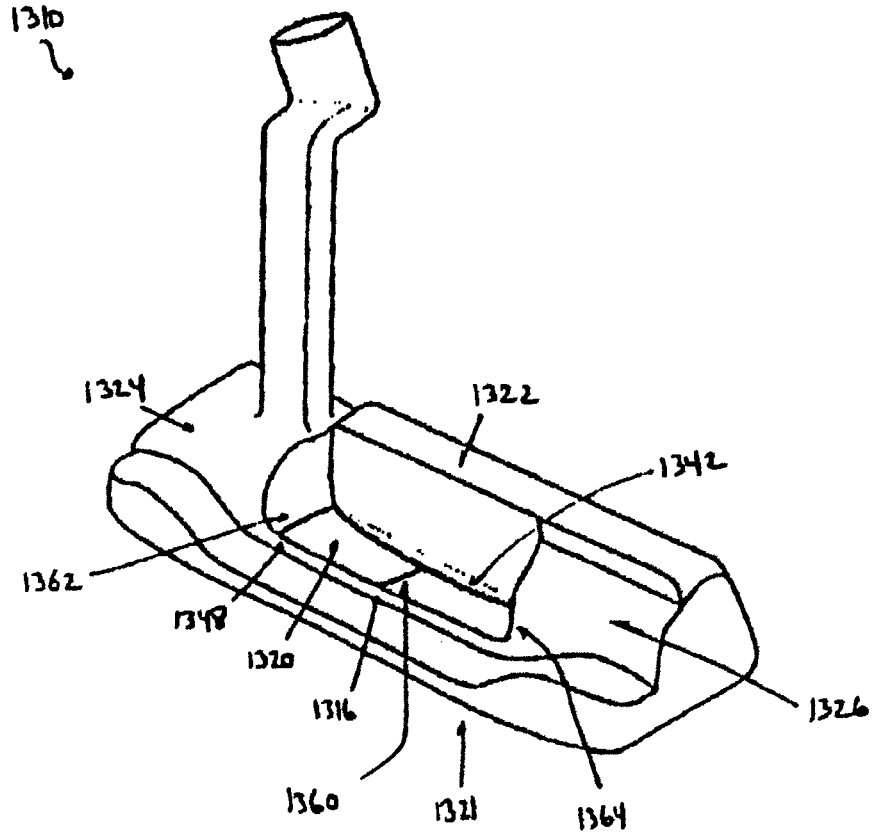
FIG. 27 is a toe perspective view of another embodiment of the current invention comprising a putter-type golf club head.

FIG. 27 illustrates another embodiment of the invention. A putter-type golf club 1310 is shown having a top portion 1322, sole portion 1316, heel portion 1324 and toe portion 1326. The sole portion 1316 comprises an upper surface

1320, bottom surface 1321 and rearward end 1348. A sink 1342 is formed within the sole portion 1316 extending substantially the entire HT length of the upper surface 1320. The HT contour of the upper surface 1320 substantially varies forming a local minimum sole height 1360 intermediate the heel-most end 1362 and the toe-most end 1364.

Figure 28:
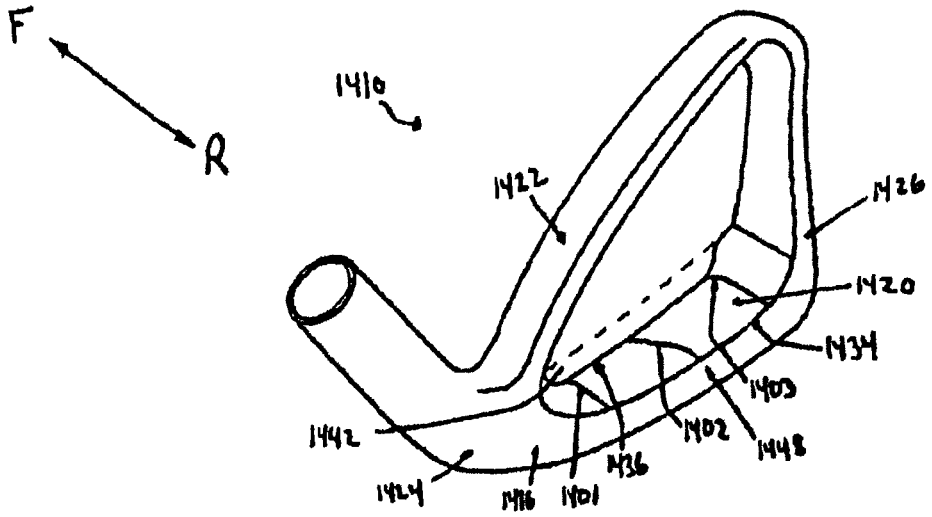
FIG. 28 is a rear, heel perspective view of a golf club head of the present invention.
Figure 29:
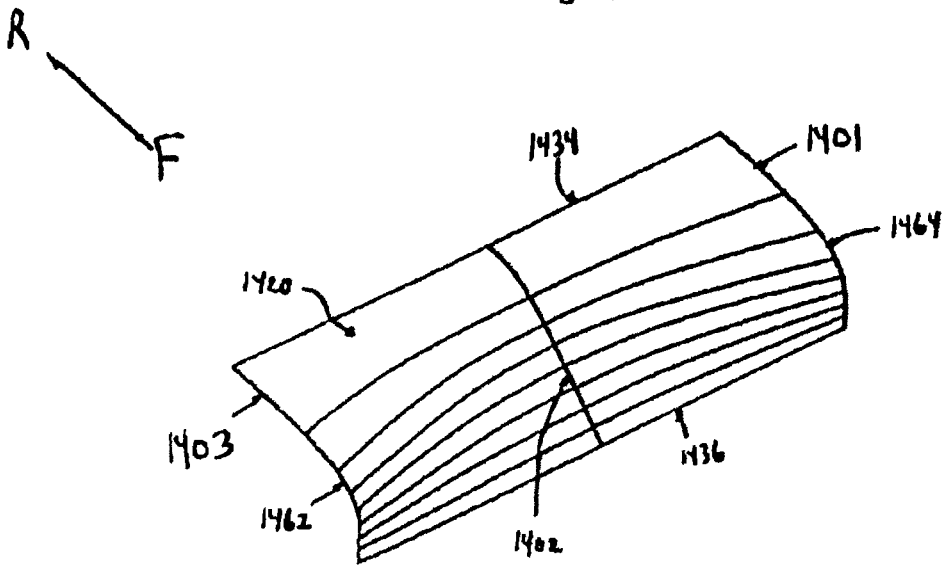
FIG. 29 is a cut away view of a sink portion of the club head of FIG. 28.
Figure 29A:
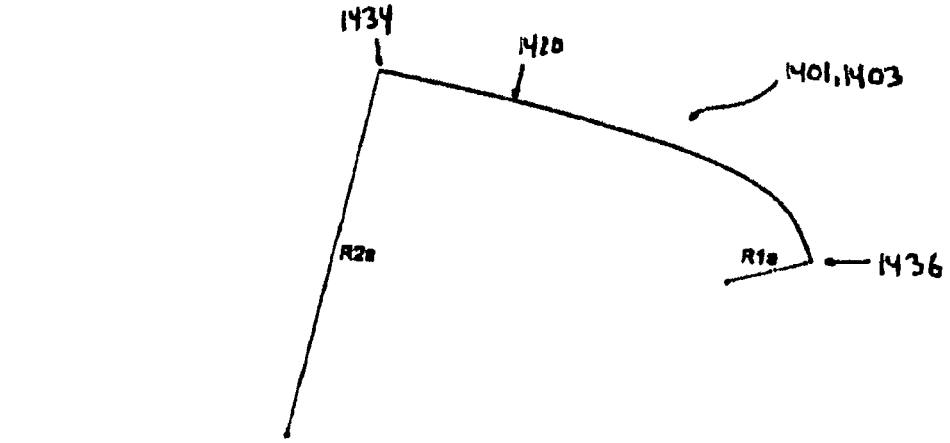
Figure 29B:
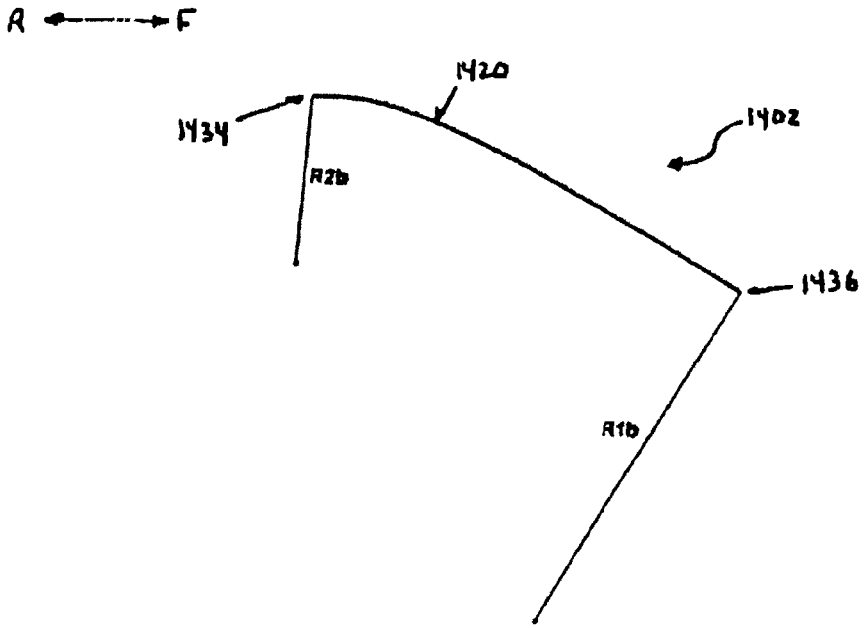

FIGS. 28 and 29 show a golf club head 1410 at address position in accordance with another embodiment of the current invention. The golf club head 1410 comprises a top portion 1422, heel portion 1424, toe portion 1426 and sole portion 1416. The sole portion 1416 comprises an upper surface 1420 having a sink portion 1442 and rearward end 1448. The upper surface 1420 within the sink portion 1442 substantially varies in HT contour, varying in concavity. At a first FR location 1401, concave curvature exists. As shown in FIG. 29(*a*), the curvature varies in the FR direction from a minimum instantaneous radius of curvature (ROC, herein) R1*a* to a maximum instantaneous radius of curvature R2*a*. Additionally, the general direction of increasing instantaneous ROC is rearward. As shown in FIG. 29(*b*), the upper surface 1420 comprises a second FR location 1402 approximately midway between the heel-most end 1462 and the toe-most end 1464. The second FR location 1402 comprises variation in instantaneous ROC from a minimum ROC R2*b* to a maximum instantaneous ROC R1*b*. The general direction of increasing instantaneous ROC is forward. A third FR location 1403 within the sink portion 1442 exists, similar in FR contour to the first FR location 1401.

Figure 30:
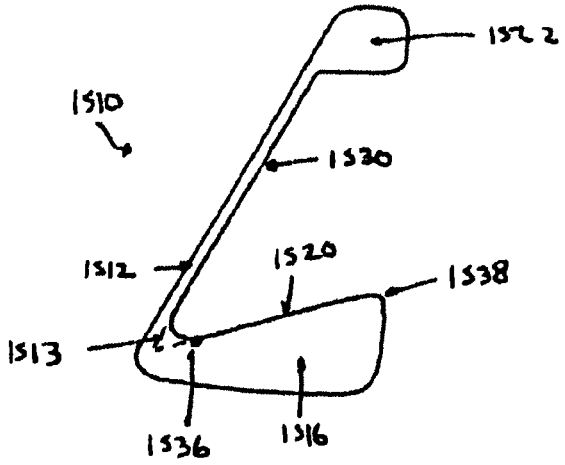
FIG. 30 illustrates a cross-sectional view of another embodiment of a golf club head in accordance with the present invention having a web portion where the rear surface of striking wall joins the upper surface of the sole portion.

FIG. 30 illustrates a cross-section of a golf club head 1510 at address position, in accordance with the current invention comprising a web portion 1513. A web portion 1513 may be present in embodiments where the perigee 1536 of the upper surface 1520 is not adjacent the rear surface 1530 of the striking wall 1512. If a web portion 1513 is present, the interior sole line 1536 may be considered to be the intersection of the web portion 1513 and the upper surface 1520 of the sole portion 1516. Curvature of the upper surface 1520 in the FR direction may thus be considered from the interior sole line 1536 and rearward, as opposed to the intersection of the web portion 1513 and the rear surface 1530 of the striking wall 1512.

Figure 31:
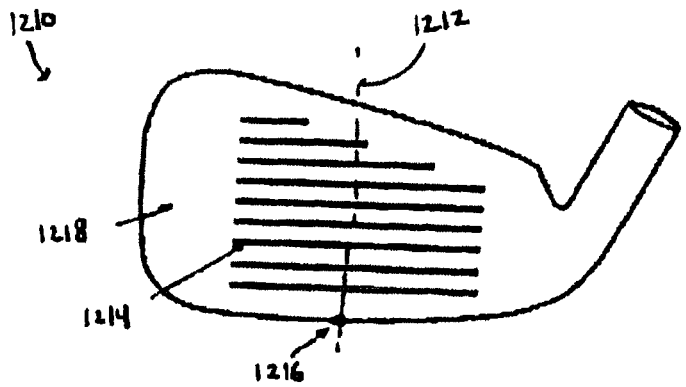
FIG. 31 is a face view of a golf club in accordance with the present invention.
Figure 32:
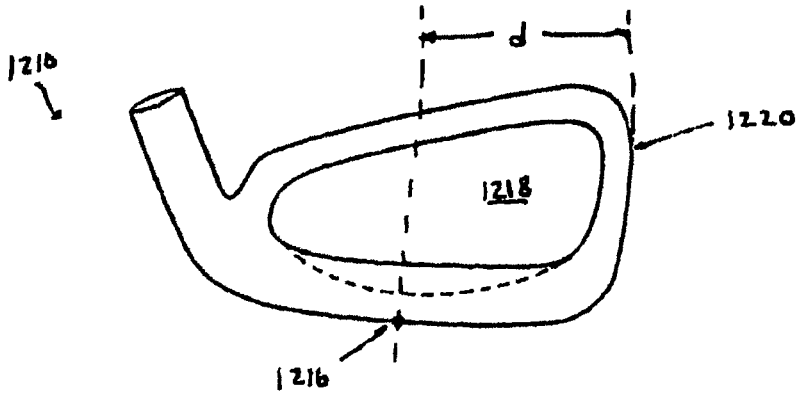
FIG. 32 is a rear view of the same golf club, both showing the location of a geometric midplane.

FIGS. 31 and 32 illustrate a golf club head 1210 at address position in accordance with the current invention. A geometric midplane is indicated by broken line 1212 shown, lying midway in the set of scorelines 1214 on the front surface of the striking wall 1218 of the golf club head 1210. The geometric midplane 1212 represent a vertical plane, perpendicular to the striking face the golf club head 1210. The midplane may coincide with the desired point of contact, or sweet spot, of the golf club head with a golf ball for straight golf ball trajectories. A distance, d, is defined as the horizontal distance from the midplane 1212 to the toe-most point 1220 of the golf club head.

Those skilled in the art of golf club head design will appreciate that minor changes in the shapes of the various elements and surfaces of the club heads of the present invention may be made within the ambit of the present invention without departing from the scope and spirit of the invention, which is defined by the following claims:

What is claimed is:

1. An iron type golf club head comprising:

a striking wall having a front surface and a rear surface;

a perimeter-weighted element extending rearwardly from said rear surface, and comprising a heel portion, a toe portion, a top portion extending from the heel portion to the toe portion, and a sole portion extending from the heel portion to the toe portion, the top portion, sole portion, toe portion, and heel portion together forming a central cavity therebetween, the sole portion including a forward end, a rearward end, an upper surface, and a lower surface, the intersection of the upper surface of the sole portion and the rear surface of the striking wall defining an interior sole line, the intersection of the upper surface of the sole portion and the rearward end of the sole portion defining a trailing-edge sole line, the perimeter-weighted element having at least one rearwardly-opening recess located within, and entirely circumscribed by, the perimeter weighted element, and a resilient polymeric element affixed to the sole portion, wherein, in an imaginary vertical plane substantially perpendicular to the front surface of the striking wall, when the golf club head is in an address position, the interior sole line is below the trailing-edge sole line.

2. The club head of claim 1, wherein, in the imaginary vertical plane, the upper surface of the sole portion tapers in height toward the interior sole line.

3. The club head of claim 1, wherein the trailing edge sole line follows a flattened V-shape.

4. The golf club head of claim 1, further comprising a region on the upper surface of the sole portion, wherein throughout the region the interior sole line is below the trailing-edge sole line, and wherein the flattened V-shape, in its entirety, corresponds with the region.

5. The golf club head of claim 1, further comprising a plaque coupled to the rear surface of the striking wall.

6. The golf club head of claim 5, wherein the plaque comprises a rigid plate and an adhesive material.

7. The golf club head of claim 1, wherein the at least one rearwardly-opening recess comprises at least two discrete rearwardly-opening recesses.

8. The golf club head of claim 7, wherein the at least two discrete rearwardly-opening recesses are generally aligned in the heel-to-toe direction.

9. The golf club head of claim 1, wherein, when the club head is oriented in the address position, in a second imaginary vertical plane, the at least one rearwardly-opening recess has a depth and a width such that the depth is greater than the width.

10. The golf club head of claim 1, wherein the polymeric element is additionally coupled to the rear surface of the striking face.

11. The golf club head of claim 1, wherein the at least one rearwardly-opening recess is generally elongate in the heel to toe direction.

12. An iron type golf club head comprising:

a striking wall having a front surface and a rear surface;

a perimeter-weighted element extending rearwardly from said rear surface, and comprising a heel portion, a toe portion, a top portion extending from the heel portion to the toe portion, and a sole portion extending from the heel portion to the toe portion, the sole portion including a forward end, a rearward end, an upper surface, and a lower surface, the intersection of the upper surface of the sole portion and the rear surface of the striking wall defining an interior sole line, the intersection of the upper surface of the sole portion and the rearward end of the sole portion defining a trailing-edge sole line, the perimeter-weighted element having at least two rearwardly-opening recesses located therein; and a polymeric element affixed to the sole portion, wherein, in an imaginary vertical plane substantially perpendicular to the front surface of the striking wall, when the golf club head is in an address position, the interior sole line is below the trailing-edge sole line.

13. The club head of claim 12, wherein, in the imaginary vertical plane, the upper surface of the sole portion tapers in height toward the interior sole line.

14. The club head of claim 12, wherein the trailing edge sole line follows a flattened V-shape.

15. The golf club head of claim 12, further comprising a region on the upper surface of the sole portion, wherein throughout the region the interior sole line is below the trailing-edge sole line, and wherein the flattened V-shape, in its entirety, corresponds with the region.

16. The golf club head of claim 12, further comprising a plaque coupled to the rear surface of the striking wall.

17. The golf club head of claim 16, wherein the plaque comprises a rigid plate and an adhesive material.

18. The golf club head of claim 12, wherein at least two rearwardly-opening recesses are generally aligned in the heel-to-toe direction.

19. The golf club head of claim 12, wherein, when the club head is oriented in the address position, in a second imaginary vertical plane, one or more of the at least two rearwardly-opening recesses have a depth and a width such that the depth is greater than the width.

20. The golf club head of claim 12, wherein the polymeric element is additionally coupled to the rear surface of the striking face.

21. The golf club head of claim 12, wherein at least one of the at least two rearwardly-opening recesses is generally elongate in the heel to toe direction.

* * * * *